US006082132A

United States Patent [19]

Numoto et al.

[11] Patent Number: 6,082,132

[45] Date of Patent: Jul. 4, 2000

[54] APPARATUS HAVING REFRIGERATION CYCLE

[75] Inventors: Hironao Numoto; Hitoshi Motegi; Kiyoshi Sawai, all of Shiga, Japan

[73] Assignee: Matsushita Electric Industrial Co., Ltd., Kadoma, Japan

[21] Appl. No.: 09/248,276

[22] Filed: Feb. 11, 1999

[30] Foreign Application Priority Data

Feb. 13, 1998 [JP] Japan ..... 10-049018

[51] Int. Cl.[7] ..... F25B 1/00

[52] U.S. Cl. ..... 62/498; 62/112; 62/114; 417/371

[58] Field of Search ..... 62/498, 112, 114

[56] References Cited

U.S. PATENT DOCUMENTS 5,051,066 9/1991 Lucas ..... 62/498 X 5,318,412 6/1994 Laskaris et al. ..... 417/417

5,670,079 9/1997 Lunger et al. ..... 62/114 X 5,957,667 9/1999 Epp ..... 417/271

*Primary Examiner*—Henry Bennett

*Assistant Examiner*—Chen-Wen Jiang

*Attorney, Agent, or Firm*—Armstrong, Westerman, Hattori, McLeland & Naughton

[57] ABSTRACT

An apparatus having a refrigeration cycle using a flammable refrigerant, comprises an oil-free compressor, a condenser, an expansion device and an evaporator, wherein an amount of lubricant in the oil-free compressor is equal to or smaller than 3 cc. With this structure, the charging amount of the flammable refrigerant into the refrigeration cycle can be reduced, and the safety of the apparatus having a refrigeration cycle can be enhanced.

10 Claims, 5 Drawing Sheets

APPARATUS HAVING REFRIGERATION CYCLE

TECHNICAL FIELD

The present invention relates to apparatus comprising a refrigeration cycle using a flammable refrigerant such as propane (R290), isobutane (R600a) and the like.

BACKGROUND TECHNIQUE

At present, Freon refrigerants that have stable properties and are easy to be handled are used as refrigerants of an apparatus having a refrigeration cycle such as a freezer, a refrigerator, an air conditioner and the like.

However, although the Freon refrigerants have stable properties and are easy to be handled, it is said that the Freon refrigerants destroy the ozone layer, and since the Freon refrigerants adversely affect the global environment, the use of the Freon refrigerants will be entirely prohibited in the future after a preparatory period of time. Among the Freon refrigerants, hydro fluorocarbon (HFC) refrigerants do not seem to destroy the ozone layer, but they have properties to facilitate the global warming. Especially in Europe where the peoples are concerned about environmental problems, there is a tendency to prohibit the use of this refrigerant also. That is, there is a tendency that the use of the Freon refrigerants that are artificially produced is prohibited, and natural refrigerants such as hydrocarbon are used as in the past. However, such natural refrigerants are flammable, and limited resources must be used effectively, there is a problem that the amount of usage must be controlled.

Thereupon, the present invention has been accomplished by taking notice of refrigerants which melt into lubricant and which do not contribute to heat transfer, and it is an object of the invention to provide an apparatus having a refrigeration cycle in which the amount of refrigerant to be charged in the refrigeration cycle is reduced to enhance the safety.

DISCLOSURE OF THE INVENTION

To achieve the above object, according to a first aspect of the present invention, there is provided an apparatus having a refrigeration cycle using a flammable refrigerant, comprising an oil-free compressor, a condenser, an expansion device and an evaporator, wherein an amount of lubricant in the oil-free compressor is equal to or smaller than 3 cc.

The oil-free compressor is a compressor which does not use the lubricant at all or uses a necessary but minimum amount of lubricant less than 3 cc, and which can compress and discharge the refrigerant without using a medium of lubricant unlike the conventional technique. Here, about 3 cc or less of lubricant is required when the mechanism section of the compressor is complicated and the mechanism section is to be assembled, or when the high-pressure agent or the antistatic agent is used.

By using such a compressor, it is unnecessary to excessively charge the refrigerant in view of the melting amount of the flammable refrigerant into the lubricant and therefore, it is possible to reduce the charging amount of refrigerant. Further, since the refrigerant should not excessively melt into the lubricant at a low temperature, the starting performance of the apparatus having a refrigeration cycle at the time of heating operation is improved. Furthermore, since the lubricant is not used, it is possible to eliminate a reduction of flow rate or a stuffed phenomenon in the expansion device due to accumulation of sludge by lubricant conventionally generated as inferior goods. Further, if the disposal problem of electric home appliances is taken into consideration, it is preferable to use the oil-free compressor.

According to a second aspect, in addition to the first aspect, the lubricant includes a high-pressure agent. With this feature, when a new compressor mechanism section is initially abraded, the high-pressure agent contributes to the sliding surfaces, which can ensure the reliability.

According to a third aspect, in addition to the first aspect, the lubricant includes an antistatic agent. With this feature, it is possible to ensure the safety of the compressor mechanism section and the motor driving portion.

According to a fourth aspect, in addition to the first aspect, the oil-free compressor is of a scroll type. In the case of the scroll, a load applied to the sliding portion is smaller than that of the rotary and the like. With this feature, it is possible to restrain the sliding surfaces from being reduced even if the lubricant is not used, and to ensure the reliability of the compressor for a long time.

According to a fifth aspect, in addition to the fourth aspect, the scroll type compressor comprises a fixed scroll and a circling scroll, the fixed scroll and the circling scroll are made of the same material, and are partially provided with a chip seal. With this feature, even when the compressor is started and the temperature rises, since the fixed scroll and the circling scroll are made of the same material, it is possible to reduce the sliding load caused by the thermal expansion, and to ensure the reliability of the compressor for a long time. Further, since the chip seals are provided on the tip ends of the scrolls, the leakage amount of the refrigerant at the time of compression can be reduced, and the efficiency can be enhanced highly.

According to a sixth aspect, in addition to the fifth aspect, the chip seal is composed of polyphenylene sulfide, carbon fiber and solid-lubricant. With this feature, the sliding performance of the fixed and circling scrolls can be enhanced, the reliability of the compressor can be ensured for a long time.

According to a seventh aspect, in addition to the first aspect, the oil-free compressor is of a linear type. With this feature, it is possible to simplify the structure of the compressor itself, to reduce the load of the sliding surfaces, and to sufficiently ensure the reliability of the compressor for a long time even if the lubricant is not used.

According to an eighth aspect, in addition to the seventh aspect, the linear type compressor comprises a cylinder and a piston, the cylinder and the piston are made of the same material, and at least one of the cylinder and the piston is provided with a ring-like seal member. Since the cylinder and the piston are made of the same material, it is possible to reduce the sliding load due to the thermal expansion, and to ensure the reliability of the compressor for a long time. Further, since the compressor mechanism section is provided with the ring-like seal, it is possible to reduce the leakage amount of the refrigerant, and the efficiency can be enhanced highly.

According to a ninth aspect, in addition to the eighth aspect, the ring-like seal member is composed of polyphenylene sulfide, carbon fiber and solid-lubricant. With this feature, the sliding performance between the cylinder and the piston can be enhanced, and the reliability of the compressor can be ensured for a long time.

According to a tenth aspect, there is provided an apparatus having a refrigeration cycle using a flammable refrigerant, comprising an oil-free compressor, a condenser, an expansion device and an evaporator.

BEST MODE FOR CARRYING OUT THE INVENTION

Embodiments of the present invention will be explained in detail with reference to the drawings below.

(First Embodiment)

Figure 1:
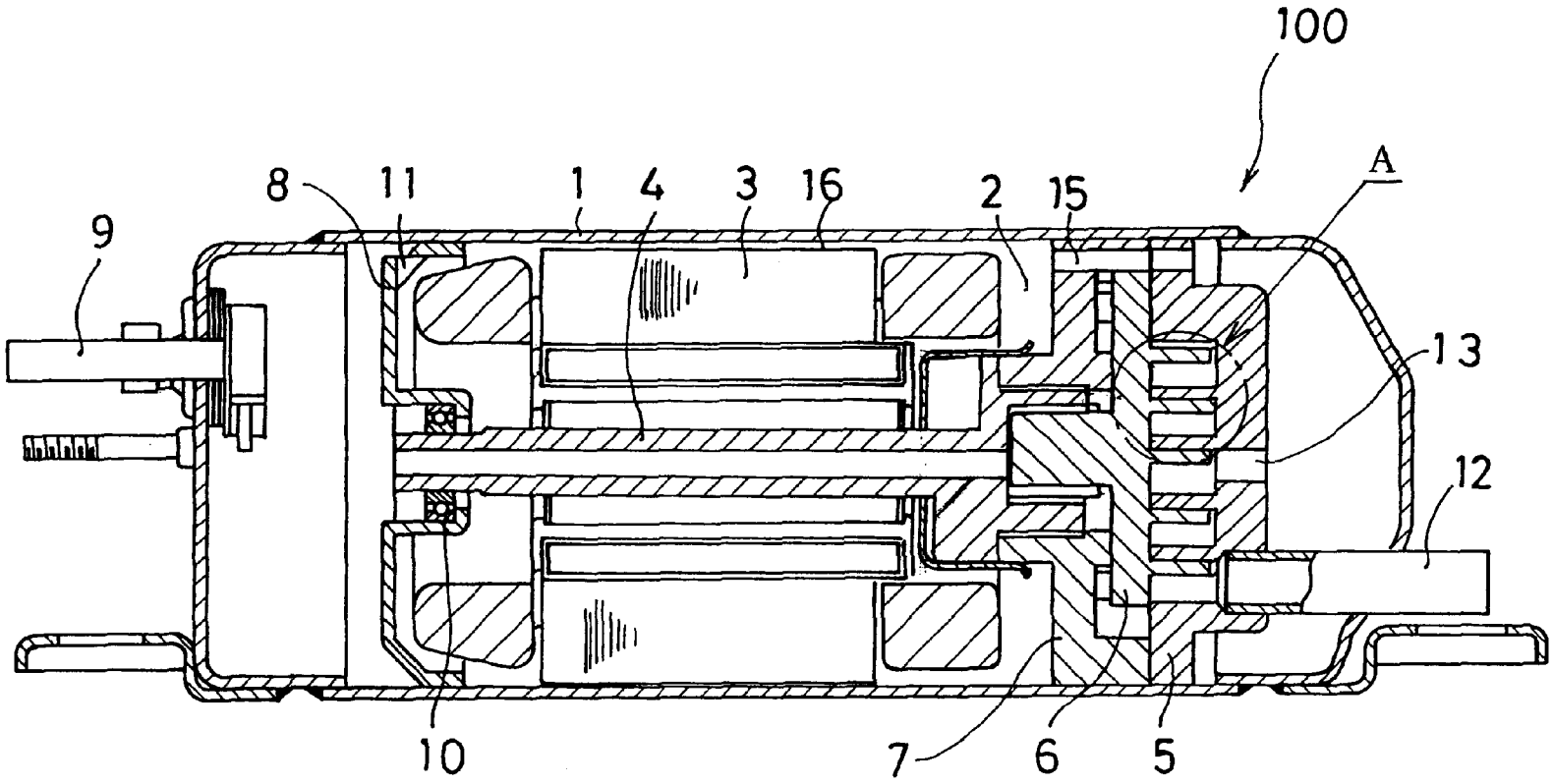
FIG. 1 is a sectional view of a scroll compressor according to an embodiment of the present invention.
Figure 2:
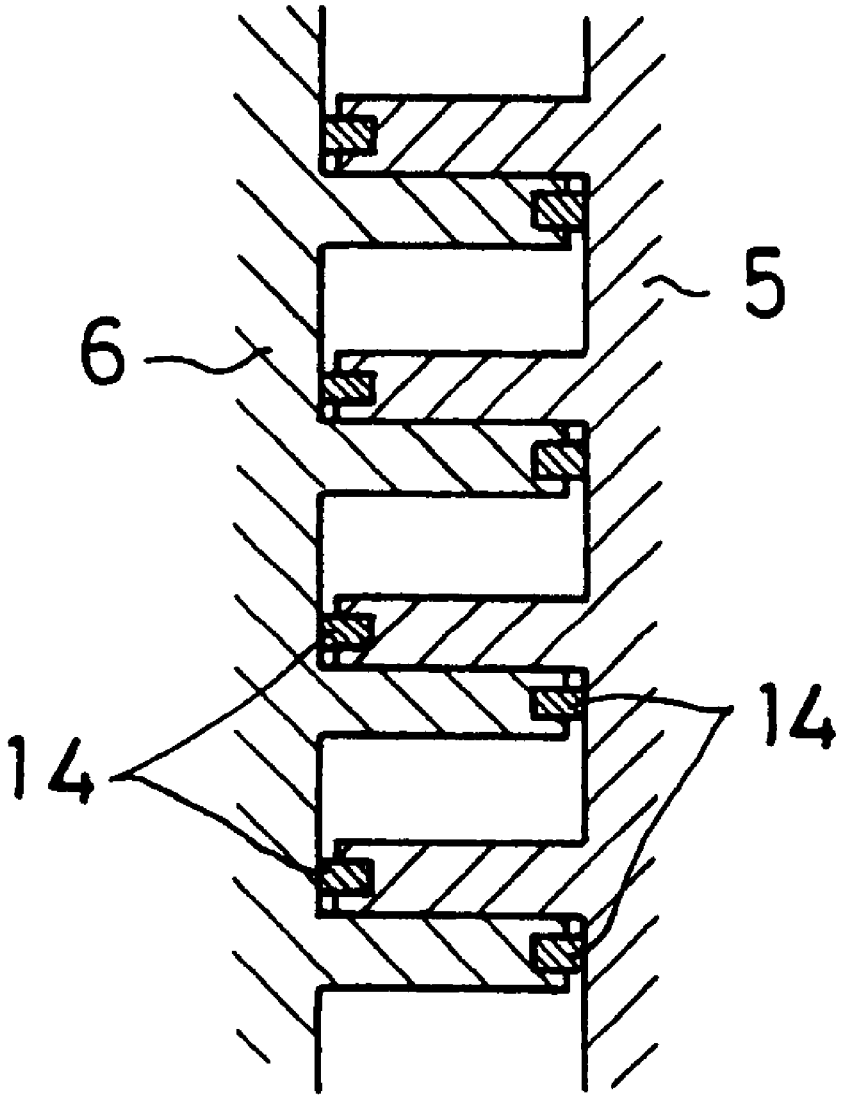
FIG. 2 is an enlarged sectional view of an essential portion of the scroll compressor according to the embodiment of the invention.

FIG. 1 shows a sectional view of a scroll compressor 100 of the first embodiment of the present invention, and FIG. 2 shows an enlarged sectional view of a portion A in FIG. 1.

An airtight container 1 is provided therein with a compressing mechanism 2, an electric motor 3 for driving the compressing mechanism 2, and a crankshaft 4 for transmitting a rotation force of the electric motor 3 to the compressing mechanism 2. The compressing mechanism 2 comprises a fixed scroll 5, a circling scroll 6, a bearing 7 and the like. Chip seals 14 are provided in clearances between tip ends of both the fixed scroll 5 and the circling scroll 6 so as to enhance the sealing performance. An auxiliary bearing holder 8 is fixed to the airtight container 1, and the airtight container 1 is divided into two, i.e., into a space in which the compressing mechanism 2 exists and a space in which a discharge pipe 9 exists. An auxiliary bearing 10 for supporting one end of the crankshaft 4 is mounted to a central portion of the auxiliary bearing holder 8. A portion of a slope of an outer periphery of the auxiliary bearing holder 8 is cut and risen vertically with respect to a wall surface of the airtight container 1 to provide a passage 11 through which refrigerant gas passes. The reference number 12 represents an intake pipe and the reference number 13 represents a discharge hole.

This scroll compressor 100 is an oil-free compressor whose oil amount including residue oil in the motor section and oil required for assembling the scroll mechanism is about 1 g in total. In the case of oil-free compressor, since leakage of refrigerant can not be prevented by utilizing an oil seal as in the conventional compressor, it is necessary to make a clearance in the mechanism section small. Therefore, if the fixed scroll 5 and the circling scroll 6 are made of different materials, great sliding abrasion is generated due to a difference in thermal expansion when the compressor is started. Therefore, in the present embodiment, both the fixed scroll 5 and the circling scroll 6 are made of cast iron.

Next, the operation of the scroll compressor 100 having the above described structure will be explained. As the electric motor 3 rotates, the crankshaft 4 rotates and as a result, the circling scroll 6 circles with respect to the fixed scroll 5. The low pressure refrigerant gas is drawn from the intake pipe 12, compressed in a space formed between the circling scroll 6 and the fixed scroll 5, and discharged into the airtight container 1 from the discharge hole 13. Then, the highly pressurized refrigerant gas passes through a gas hole 15 formed in the compressing mechanism 2 and through a groove 16 and the like provided in the electric motor 3 and reaches the auxiliary bearing holder 8. Then, the high pressure refrigerant gas passes through the passage 11 provided in the auxiliary bearing holder 8 and discharged out of the scroll compressor 100 from the discharge pipe 9.

Figure 3:
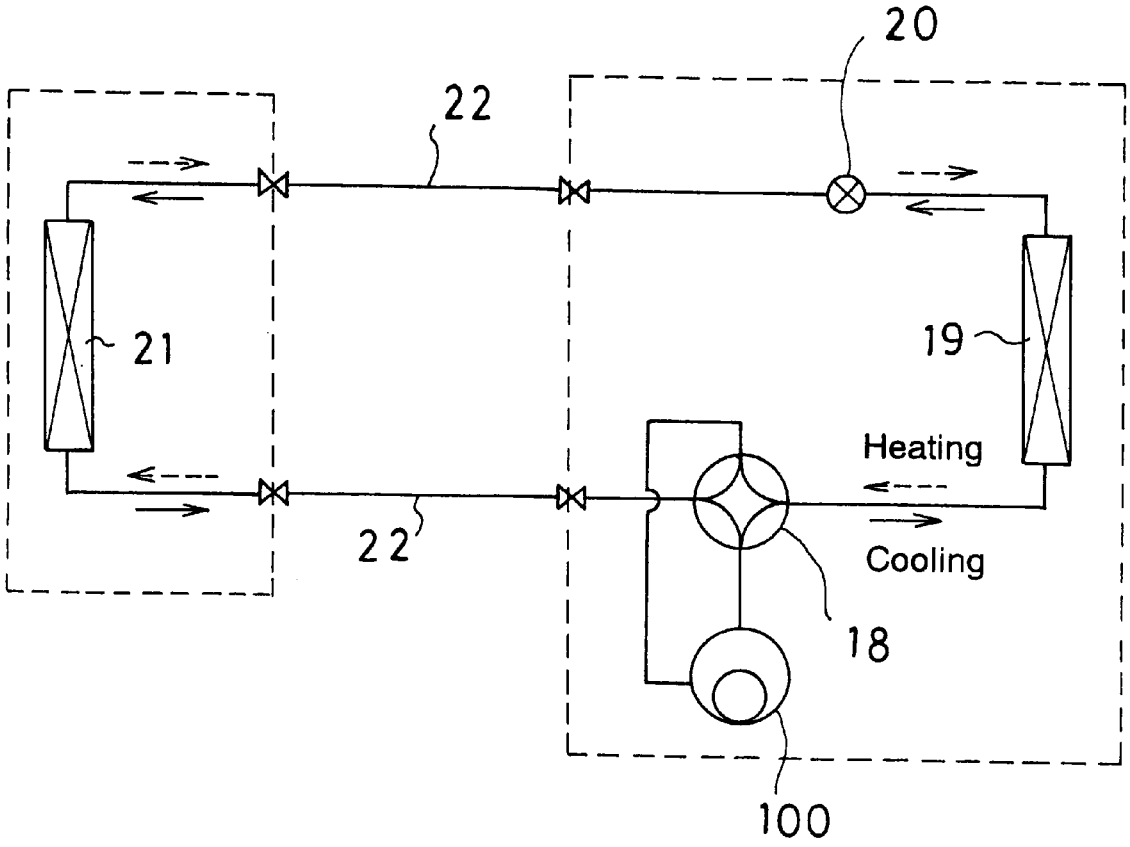
FIG. 3 is a block diagram of a cycle of an air conditioner according to the embodiment of the invention.

Using the scroll compressor 100 structured as described above, an air conditioner using propane as the refrigerant was produced. FIG. 3 shows its refrigeration cycle.

The compressor 100, a 4-way valve 18, an outdoor heat exchanger 19, and an expansion device 20 are disposed in an outdoor unit. An indoor heat exchanger 21 is disposed in an indoor unit. The reference number 22 represents inside/outside connecting pipes.

This air conditioner could obtain a cooling capacity of 2.5 kw by charging 250 g of propane in the refrigeration cycle. Further, it took 9 minutes to reach a rated heating capacity at open air temperature of 0° C.

(Comparative Example 1)

An air conditioner having the same structure as that in the first embodiment was produced using a scroll compressor which used R22 as refrigerant with out using the chip seal. 300 g of lubricant was used.

In this refrigeration cycle, 400 g of propane was necessary to obtain a cooling capacity of 2.5 kw. It took 14 minutes to reach a rated heating capacity at open air temperature of 0° C.

As a result of comparison between the first embodiment and the comparative example 1, it was found that an amount of refrigerant (propane) required for obtaining the same capacity could be reduced about 38% by using the oil-free compressor. Further, since the refrigerant did not melt into oil at a low heating temperature at the time of heating operation, a time required for obtaining the rated heating capacity could be shortened.

The chip seals 14 were used at the tip ends of the fixed scroll 5 and the circling scroll 6 in the first embodiment, and the cooling capacity was enhanced about 5% by using the chip seals 14 as compared with a case in which the chip seals were not used. It is difficult, in terms of technique, to partially improving the sliding movement of only the tip ends of the fixed scroll 5 and the circling scroll 6. Therefore, it is possible to reduce the contact areas between the tip ends of the fixed scroll 5 and the circling scroll 6 to enhance the lubrication by employing material having excellent sliding performance for the chip seal.

It is preferable that the chip seal used in the present embodiment is composed of polyphenylene sulfide (PPS), carbon fiber and solid-lubricant. The solid-lubricant here should be selected from graphite, molybdenum disulfide, tungsten disulfide, boron nitride, polytetrafluoroethylene, polyimide and the like.

Since compressor oil is not used in the present embodiment, the initial abrasion at the sliding portions is the biggest problem in view of the reliability. To solve this problem, it is possible to use only a small amount of high-pressure agent directly in the compressor. Further, it is also possible to add the high-pressure agent in the mechanism assembling oil.

As the high-pressure agent, it is possible to select from chlorinated paraffin, chlorinated fatty acid ester, mineral oil sulfide, polysulfide, phosphate, phosphite and the like.

By using 1 to 2 cc of effective high-pressure agent, drape at the time of initial impulse of the mechanism portion can be enhanced.

Further, since the flammable refrigerant is used in the present embodiment, seizing and spark within the refrigeration cycle are very dangerous. Therefore, to avoid this problem, a small amount of antistatic agent can be used. As the way of using the agent, the agent may be directly used in the compressor, or the agent may be added to the mechanism assembling oil.

As the antistatic agent of the present embodiment, about 0.5 to 1 cc of carboxylic acid amine salt is used. By using this amine salt together with the high-pressure agent, antistatic effect can also be obtained without deteriorating the sliding performance.

(Second Embodiment)

Figure 4:
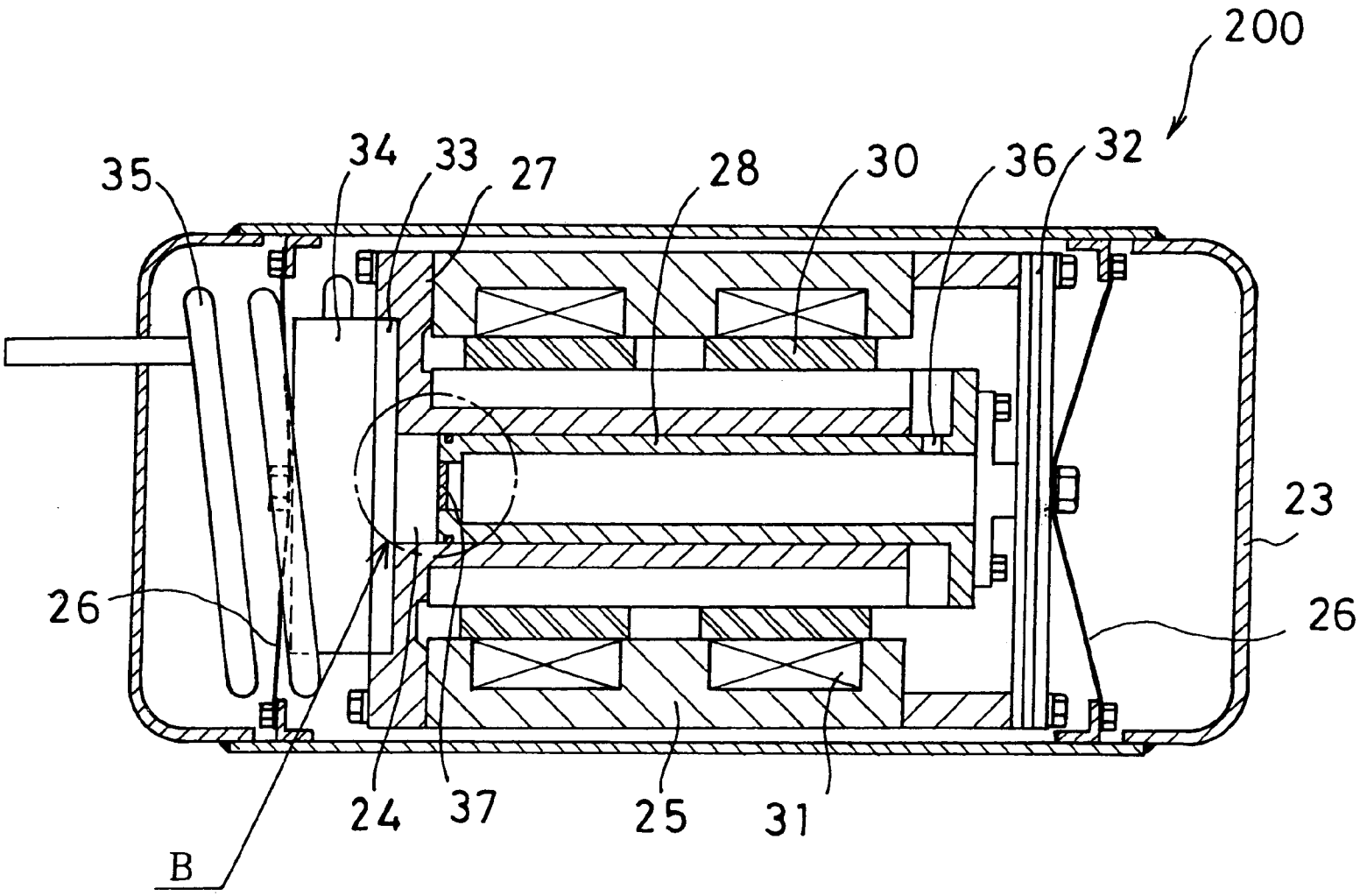
FIG. 4 is a sectional view of a linear compressor according to a second embodiment of the invention.
Figure 5:
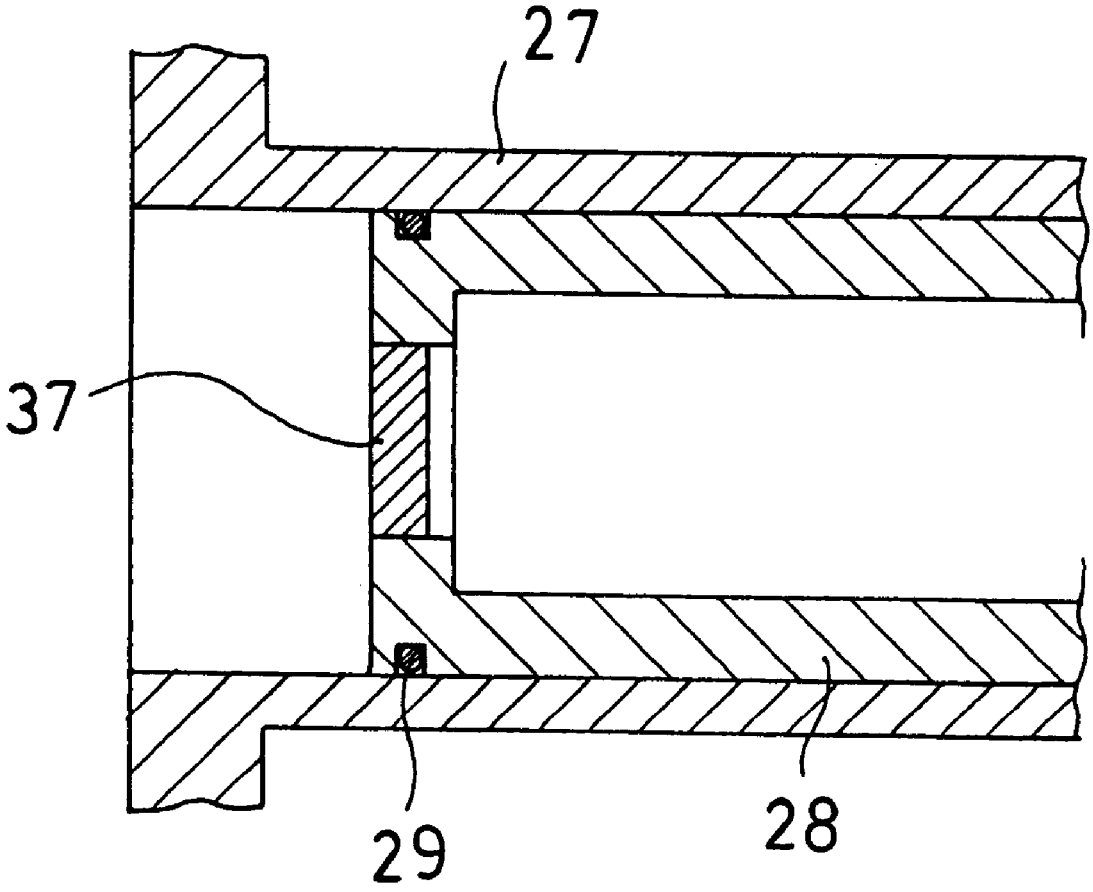
FIG. 5 is an enlarged sectional view of an essential portion of the linear compressor according to the second embodiment of the invention.

FIG. 4 shows a sectional view of a linear compressor 200 of the second embodiment of the invention, and FIG. 5 shows an enlarged sectional view of a portion B in FIG. 4. An airtight container 23 is provided therein with a compressing mechanism 24 and a linear motor 25 for driving the compressor mechanism 24. The compressor mechanism 24 and the linear motor 25 are supported at their opposite sides by supporting springs 26 fixed to the airtight container 23. The compressing mechanism 24 comprises a cylinder 27, a piston 28 and the like. The piston 28 is fitted into the cylinder 27. As shown in FIG. 5, the piston 28 is provided with a piston ring 29. Magnets 30 are fixed to the outer periphery of the piston 28. A stator 31 is disposed such as to oppose to the magnets 30. One end of the stator 31 is fixed to the cylinder 27, and the other end thereof is fixed to a resonance spring 32. One end of the piston 28 is supported by a supporting spring 26 and the resonance spring 32. A discharge valve supporting member 33 having a discharge valve therein and a muffler 34 are connected to the cylinder 27. A discharge pipe 35 is disposed spirally from a side of the muffler 34. The piston 28 is provided with an intake hole 36 and an intake valve 37.

This linear compressor 200 is an oil-free compressor whose oil amount including residue oil in the motor section and oil required for assembling the linear mechanism is about 0.3 g in total. Any kind of oil may be used. Both the cylinder 27 and the piston 28 are made of cast iron in the present embodiment also.

Next, the operation of the linear compressor 200 having the above-described structure will be explained. By supplying electricity to the stator 31 of the linear motor 25, the piston 28 to which the magnets 30 are fixed moves in the opposite direction from the discharge pipe 35 for drawing the refrigerant. The low pressure refrigerant is drawn from the intake hole 36 disposed in a side of the piston 28, and is introduced into a space formed by the cylinder 27 and the piston 28 while pushing and opening the intake valve 37 having a damper mechanism.

If the supply of electricity to the stator 31 is stopped, energy accumulated in the resonance spring 32 is released, the piston 28 is pulled back to the original state (in the direction of the discharge pipe 35), and the refrigerant gas is compressed. The compressed refrigerant gas pushes and opens a discharge valve (not shown) provided on the central portion of the discharge valve supporting member, and is discharged into the muffler 34. Then, the high pressure refrigerant gas is discharged out from the linear compressor 200 through the discharge pipe 35. At that time, the compression capacity is varied by the number of operations or amount of operation of the piston 28, and by the number of electricity supply or amount of electricity to the linear motor. Vibration generated by the operation of the compressor such as drawing and discharging operations is controlled by the supporting springs 26, and vibration and noise of the airtight container 23 itself are reduced.

Using the linear compressor 200 structured as described above, an air conditioner similar to that of the first embodiment using propane as the refrigerant was produced. This air conditioner could obtain a cooling capacity of 2.5 kw by charging 250 g of propane in the refrigeration cycle. Further, it took 8 minutes to reach a rated heating capacity at temperature of 0° C.

As a result of comparison between the second embodiment and the comparative example 1, it was found that an amount of refrigerant (propane) required for obtaining the same capacity could be reduced about 38% by using the oil-free compressor. Further, since the refrigerant did not melt into oil at a low heating temperature at the time of heating operation, a time required for obtaining the rated heating capacity could be shortened.

In the second embodiment, the piston 28 is provided with the piston ring 29. By providing this piston ring 29, the cooling capacity was enhanced about 8%. Although it is possible to reduce the amount of leakage of the refrigerant by reducing the clearance between the cylinder 27 and the piston 28, if the clearance is too small, it is difficult to fit the piston 28 into the cylinder 27 in terms of productivity. Therefore, it is possible to reduce the contact areas between the cylinder 27 and the piston 28 to enhance the lubrication by employing material having excellent sliding performance as for the piston ring 29. Further, when the compressor is produced and assembled, it is preferable to use a small amount of lubricant so as to facilitate the fitting operation of the piston into the cylinder. Although the piston ring 29 is used in the second embodiment, a stop ring having the same sealing capacity may be used for the cylinder.

It is preferable that the ring-like sealing member is composed of polyphenylene sulfide, carbon fiber and solid-lubricant. The solid-lubricant here should be selected from graphite, molybdenum disulfide, tungsten disulfide, boron nitride, polytetrafluoroethylene, polyimide and the like.

The high-pressure and antistatic agent may be used for the linear compressor of the present embodiment as in the first embodiment of the scroll compressor 100. The effect obtained by using the high-pressure agent and the antistatic agent was substantially the same as that of the scroll compressor.

As is apparent from the above-described embodiments, by using the oil-free compressor, it is unnecessary to excessively charge the refrigerant in view of the melting amount of the flammable refrigerant into the lubricant and therefore, it is possible to minimize the charging amount of refrigerant. Further, since the refrigerant should not melt into the oil at low temperature unlike the conventional compressor, the starting performance of the apparatus having a refrigeration cycle at the time of heating operation is improved. Further, since the compressor is of the oil-free type, it is easy to cope with disposal problem of electric home appliances.

By using the high-pressure agent, when a new compressor mechanism section is initially abraded, the high-pressure agent contributes to the sliding surfaces, which can ensure the reliability.

By using the antistatic agent, it is possible to ensure the safety of the compressor mechanism section and the motor driving portion.

By using the scroll type oil-free compressor, it is possible to restrain the sliding surfaces from being reduced even if the lubricant is not used, and to ensure the reliability of the compressor for a long time.

Further, the fixed scroll and the circling scroll are made of the same material, and the chip seals composed of polyphenylene sulfide, carbon fiber and solid-lubricant are provided on the tip ends of the scrolls. Therefore, it is possible to reduce the sliding load due to the thermal expansion, to enhance the sliding characteristics, and to ensure the reliability of the compressor for a long time.

By using the linear type oil-free compressor, it is possible to simplify the structure of the compressor itself, to restrain the sliding surfaces from being reduced even if the lubricant is not used, and to ensure the reliability of the compressor for a long time.

Further, since the cylinder and the piston of the linear compressor are made of the same material, the load of the sliding surfaces can be reduced. Since the cylinder or the piston is provided with the ring-like seal member made of polyphenylene sulfide, carbon fiber and solid-lubricant, it is possible to reduce the leakage amount of the refrigerant at the time of compression, and to highly improve the efficiency.

What is claimed is:

1. An apparatus having a refrigeration cycle using a flammable refrigerant, comprising an oil-free compressor, a condenser, an expansion device and an evaporator, wherein an amount of lubricant in said oil-free compressor is equal to or smaller than 3 cc and said oil-free compressor is one of a scroll-type and a linear type.

2. An apparatus having a refrigeration cycle according to claim 1, wherein said lubricant includes a high-pressure agent.

3. An apparatus having a refrigeration cycle according to claim 1, wherein said lubricant includes an antistatic agent.

4. An apparatus having a refrigeration cycle according to claim 1, wherein said oil-free compressor is of a scroll type.

5. An apparatus having a refrigeration cycle according to claim 4, wherein said scroll type compressor comprises a fixed scroll and a circling scroll, said fixed scroll and said circling scroll are made of the same material, and are partially provided with a chip seal.

6. An apparatus having a refrigeration cycle according to claim 5, wherein said chip seal is composed of polyphenylene sulfide, carbon fiber and solid-lubricant.

7. An apparatus having a refrigeration cycle according to claim 1, wherein said oil-free compressor is of a linear type.

8. An apparatus having a refrigeration cycle according to claim 7, wherein said linear type compressor comprises a cylinder and a piston, said cylinder and said piston are made of the same material, and at least one of said cylinder and said piston is provided with a ring-like seal member.

9. An apparatus having a refrigeration cycle according to claim 8, wherein said ring-like seal member is composed of polyphenylene sulfide, carbon fiber and solid-lubricant.

10. An apparatus having a refrigeration cycle using a flammable refrigerant, comprising an oil-free compressor, a condenser, an expansion device and an evaporator, wherein said oil-free compressor is one of a scroll-type and a linear type.

* * * * *